United States Patent [19]

Spehar

[11] Patent Number: 5,009,170

[45] Date of Patent: Apr. 23, 1991

[54] PORTABLE BODY MASSAGE TABLE

[75] Inventor: Eli G. Spehar, Huntington Beach, Calif.

[73] Assignees: Rodney B. Smith, Escondido; Ernest L. Ostic, Orange, both of Calif.

[21] Appl. No.: 309,784

[22] Filed: Feb. 10, 1989

[51] Int. Cl.[5] ..... A47B 3/00

[52] U.S. Cl. ..... 108/36; 108/38; 108/132

[58] Field of Search ..... 108/36, 38, 35, 34, 108/33, 112, 113, 130, 131, 132; 5/446, 431

[56] References Cited

U.S. PATENT DOCUMENTS

| | | | |
|---|---|---|---|
| D. 295,349 | 4/1988 | Mueller . | |
| 1,062,996 | 5/1913 | Sornberger . | |
| 1,530,726 | 3/1925 | Koenigkramer | 108/35 |
| 2,167,342 | 7/1939 | York | 108/35 |
| 2,579,783 | 12/1951 | Branto . | |
| 2,673,774 | 3/1954 | Di Prima | 108/36 |
| 2,747,957 | 5/1956 | Lencioni | 108/36 |
| 2,759,576 | 8/1956 | Townsend . | |
| 2,937,062 | 5/1960 | Kruse . | |
| 4,259,757 | 4/1981 | Watson | 5/446 X |
| 4,333,638 | 6/1982 | Gillotti . | |

FOREIGN PATENT DOCUMENTS

| | | | |
|---|---|---|---|
| 3012683 | 10/1980 | Fed. Rep. of Germany | 108/36 |

*Primary Examiner*—José V. Chen

[57] ABSTRACT

A padded table for body massage or chiropractic work having a flat working surface supported upon folding legs. Table construction includes two flat top sections joined by a piano hinge so that they may be folded into parallel adjacent positions to form a case like structure which is easily carried, or they may be unfolded to form a single planar table top. When unfolded, support legs hold the table top parallel to a support surface. A unique brace and cable configuration is employed which provides table rigidity, strength and easy, fast unfolding.

4 Claims, 3 Drawing Sheets

PORTABLE BODY MASSAGE TABLE

BACKGROUND OF THE INVENTION

The invention relates to folding tables in general, and specifically to tables for use in massage or therapeutic body work such as for the chiropractic art. The important aspect of this invention deals with the method for supporting said table while in use, and also to certain novel aspects of setting-up and refolding the table.

DESCRIPTION OF THE PRIOR ART

The prior art teaches a wide variety of special purpose folding tables for use in applications such as massage, therapy, chiropractic arts, article display, and beauty treatment as well as folding tables for general purpose use. Important prior art includes U.S. Pat. No. 1,062,996 which teaches the basic concept of support elements folding into the space between center hinged surface elements; U.S. Pat. No. D295,349 which teaches box support design; U.S. Pat. Nos. 2,579,783 and 2,759,576 and 2,937,062 all of which teach methods of using the surface elements as case elements, and U.S. Pat. No. 4,333,638 which teaches a folding table having features similar to the instant invention.

None of the prior art disclosures show the combination of features and capabilities of the instant invention. It is the applicants opinion that the unique combination of support elements used in the present invention contribute to a stronger table in both the lateral directions as well as the vertical direction. Strength, light weight, ease and speed of setup and breakdown all make the instant invention quite unique and an extremely useful device.

SUMMARY OF THE INVENTION AND OBJECTS

The within invention consists of a special purpose table for use in massage or other body work such as theraphy or chiropractic arts. The table folds in half and stores its legs and other support elements within the space between the two halves of the folded top sections. When folded, the table can be easily carried by one individual so that the table is useful for temporary service and is conveniently stored and moved about.

It is the primary object of the instant invention to provide an improved folding table having a new and unique support structure design which overcomes the drawbacks found in prior art devices.

Another object of the disclosed invention is to provide a table that is incredibly strong and therefore resistant to static as well as dynamic loads.

Another important object of the invention is to provide a table that is very light in weight and therefore easily carried about.

A further object of the invention is to provide a table that can be unfolded and setup in less than two seconds with a single opening motion whereby the undercarriage drops down automatically and requires no manual locking nor any locking mechanism.

A yet further object of the invention is to provide a table that can be adjusted for height and leveled.

Another important object of the invention disclosed within is to provide a table having a padded top surface and an opening for a person's face thereby providing convenience for massage therapy.

These, together with the various ancillary objects and features of the instant invention which will become apparent as the following description proceeds, are attained by this folding, portable massage table as disclosed herein, preferred embodiments thereof being shown in the accompanying drawings, by way of example only.

DRAWING REFERENCE NUMERALS

10—Folding Table
20—Top section
25—Cushion pad
26—Face opening
30—Support leg
35—First pivot means
36—Second pivot means
37—Third pivot means
38—Fourth pivot means
40—First cross brace
42—Second cross brace
50—First length
60—Second length
80—Border flange
90—Carrying handle
110—Latch
115—Latch clasp
120—Second cable
130—First cable
140—Angle bracket
150—Ferrule
170—Nut
180—Bolt
190—Adjustable foot
200—Hinge member
210—Support foot

DESCRIPTION OF THE PREFERRED EMBODIMENT

Figure 1:
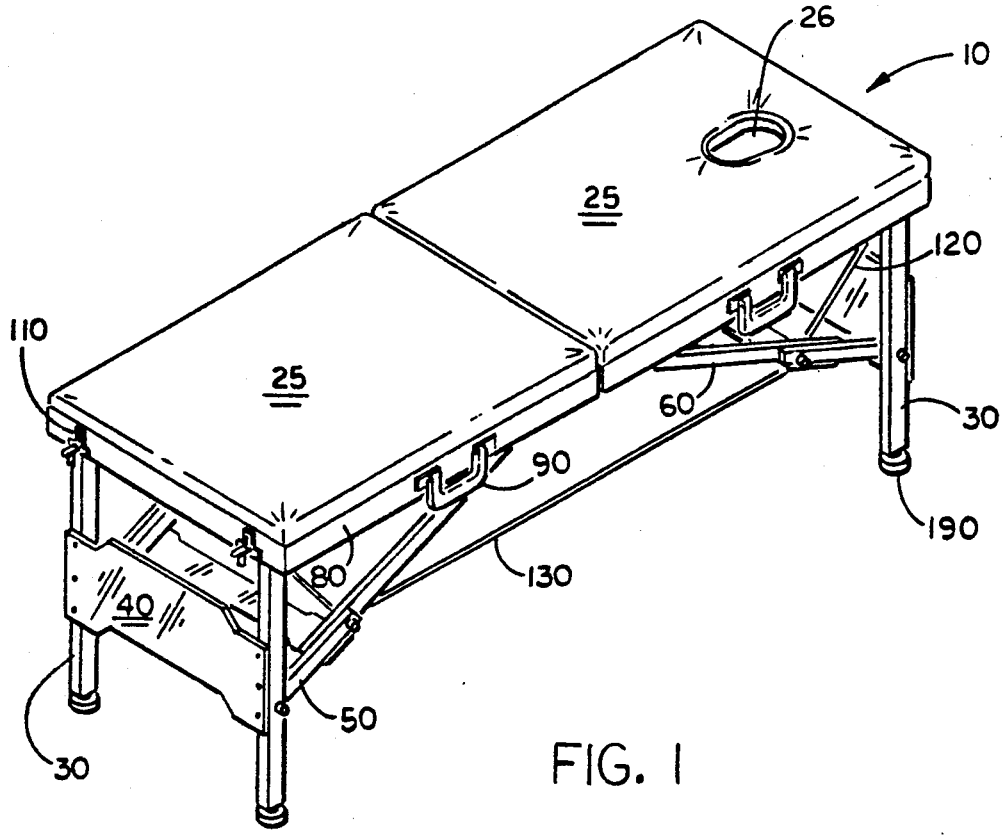
FIG. 1 is a perspective drawing of the invention when unfolded as seen from above.
Figure 2:
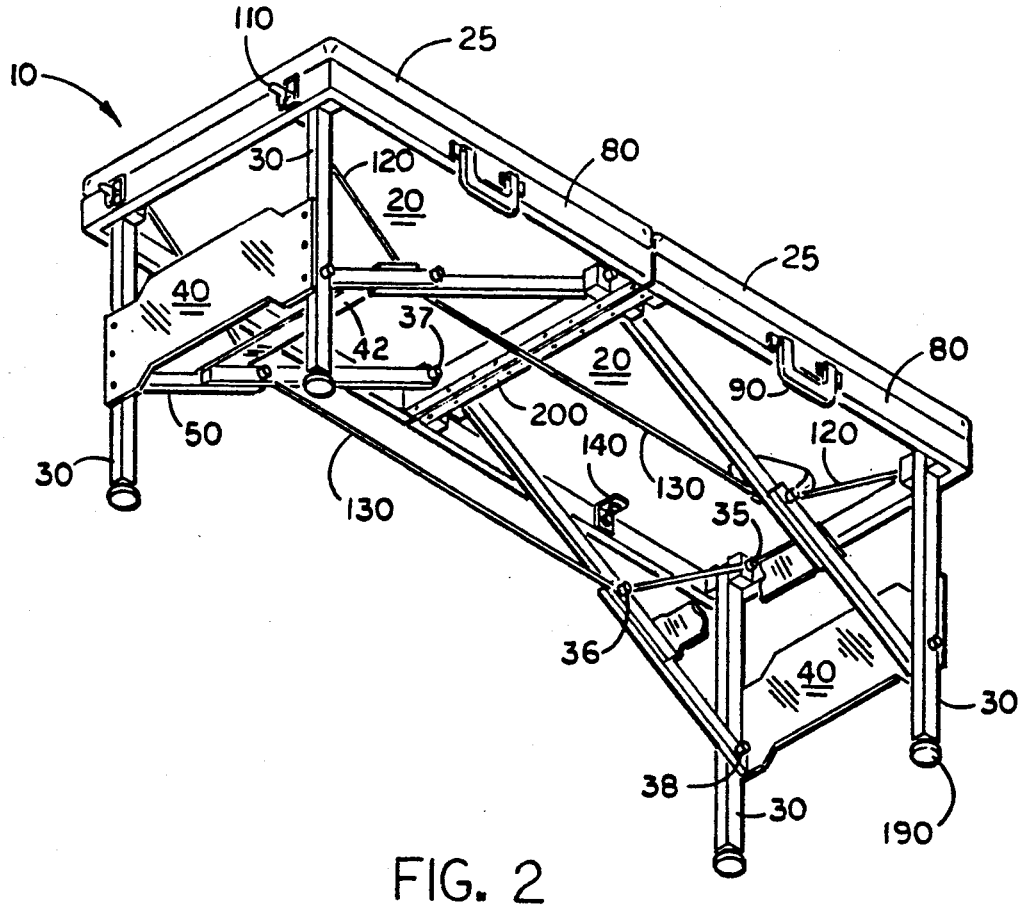
FIG. 2 is a perspective drawing of the invention unfolded as seen from below.
Figure 5:
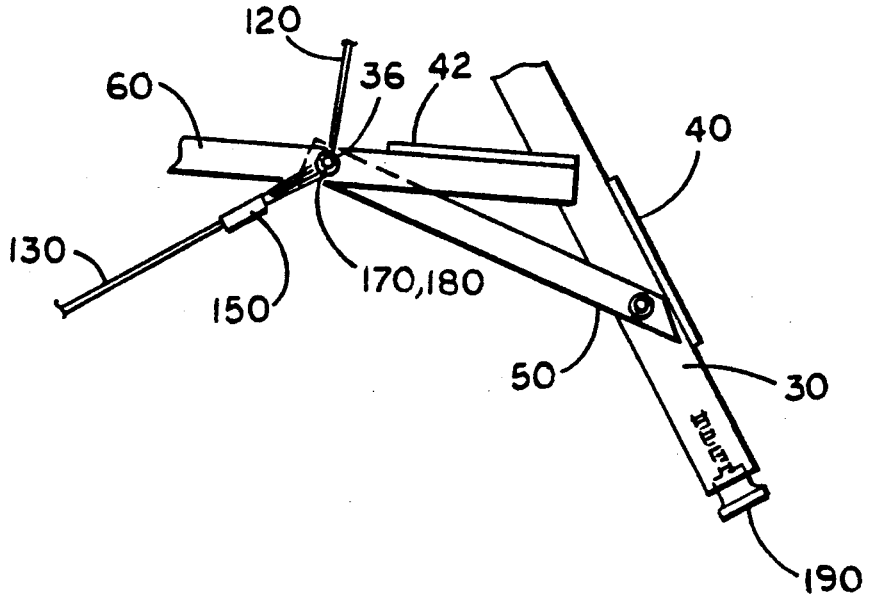
FIG. 5 shows support element attachment.

As shown in FIGS. 1 and 2, folding table 10 comprises two rectangular flat top sections 20 each of which contains, on its under surface a peripheral border flange 80 anchored to top sections 20 with angle brackets 140. Sections 20 are abutted and connected by hinge member 200 attached to the bottom surface of border flanges 80. Sections 20 are covered with cushion pads 25 with one section having face opening 26. At the outer end of each section 20 a pair of support legs 30 is attached by first pivot means 35. Each pair of support legs 30 are rigidly connected by first cross brace 40. Each leg 30 contains an adjustable foot 190. Each section 20 has a pair of support arms, each arm comprising a first length 50 and a second length 60 interconnected by second pivot means 36. Each pair of second lengths 60 are rigidly connected by second cross brace 42. The free end of each first length 50 is connected to border flange 80 by third pivot means 37, while the free end of each first length 50 is connected to support leg 30 by fourth pivot means 38. A pair of first cables 130 is connected between each pair of opposing second pivot means 36. Each pivot means 35, 36, 37, 38 is comprised of a bolt 180 and an anchoring nut 170. In each top section 20 a pair of second cables 120 is connected between each pair of first pivot means 35 and second pivot means 36. Cables 120, 130 are anchored to pivot means 35, 36 by forming a loop around bolt 180 with each cable end fastened by ferrule 150 as shown in FIG. 5.

OPERATION OF THE INVENTION

Folding table 10 is shown in FIGS. 1 and 2 unfolded and ready for use. In use, as for a massage table, adjustable feet 190 support table 10 upon a floor or other flat surface. Weight placed upon top sections 20 is passed through first and second lengths 50, 60, and also passed directly, to support legs 30 and thereby transferred to the floor. The abutted ends of sections 20 being connected by hinge member 200 tend to flex downward under load causing legs 30 to tend to move outward from hinge member 200. This is prevented by first cable 130 which is in tension from downward force transferred through opposing second lengths 60. Additional strength and rigidity is provided by second cables 120 which act to maintain first and second lengths 50, 60 in precise colinearity, thus assuring rigidity of the bracing action of lengths 50 and 60. Table height is variable and footing is leveled using adjustable feet 190. First and second cross braces 40, 42 provide lateral strength. Cushion pads 25 comfortably support a reclining figure. Face opening 26 allows linear spine orientation during massage.

Figure 3:
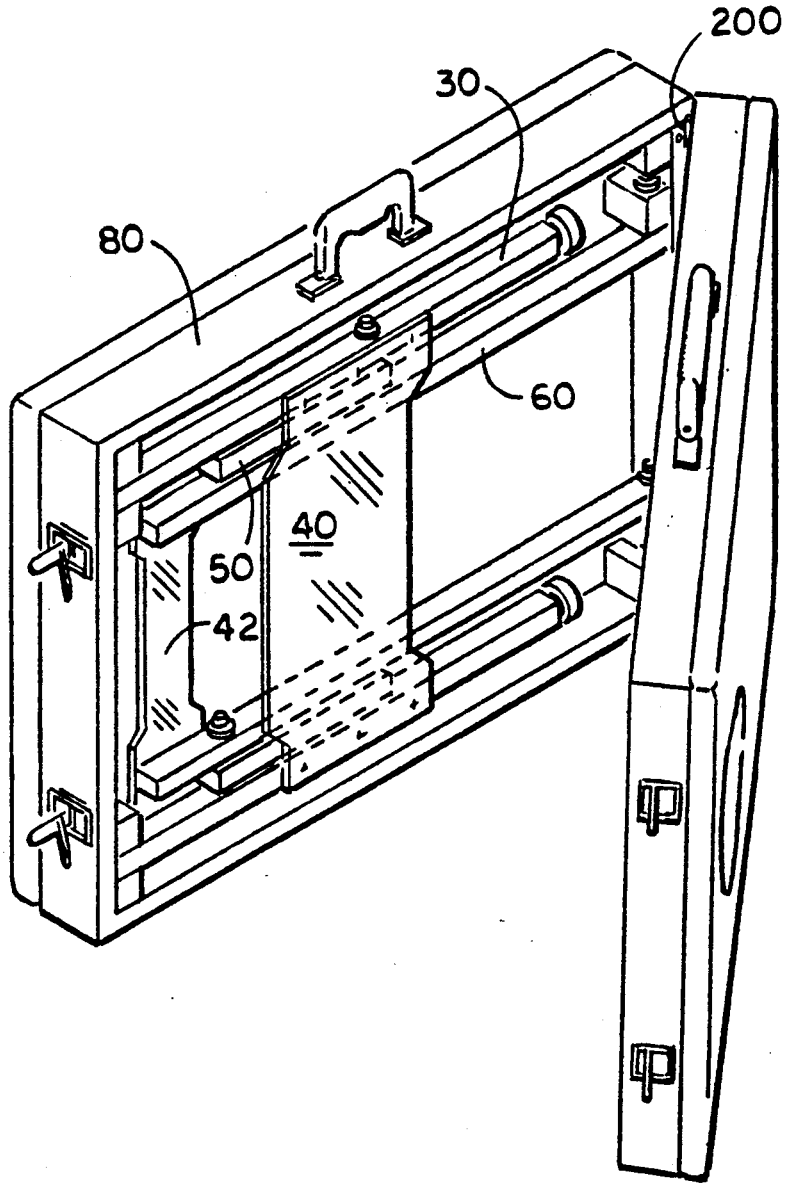
FIG. 3 is a perspective drawing of the invention with legs folded.
Figure 4:
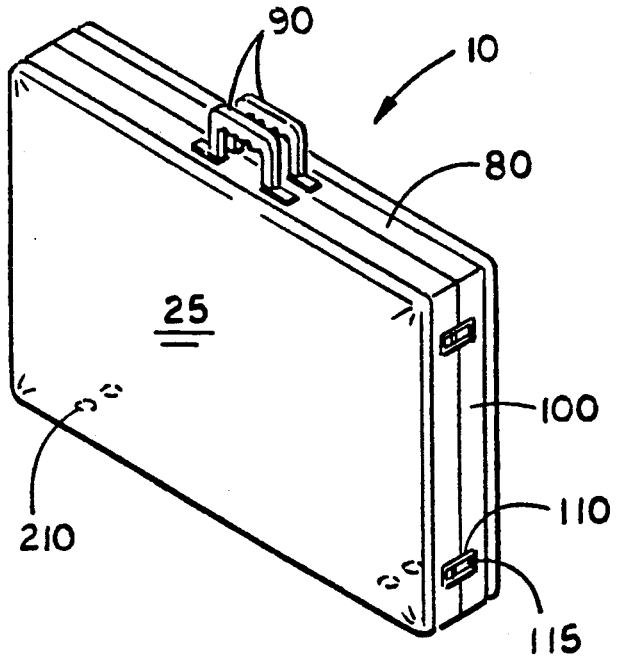
FIG. 4 is a perspective drawing of the invention when folded.

Folding table 10 is easily carried by folding the entire supporting structure into recess formed by border flange 80. FIG. 5 shows how when table 10 is placed upon one side, length 50, 60 can be broken about second pivot means 36 and folded toward top section 20 with legs 30 following. FIG. 3 shows the supporting structure folded into place within top section 20. FIG. 4 shows table 10 with both top sections 20 closed against each other and with latch 110 locked against latch clasp 115. Carrying handles 90 are attached on one side of border flange 80 while on the other side are attached support feet 210 used to rest table 10 upon when folded.

To open table 10 from the folded orientation, latches 110 are opened, handles 90 are grasped, one in each hand, and table 10 is swung up to approximately waist height, with hinge member 200 facing upward, while simultaneously pulling handles 90 apart. As top sections 20 assume coplanar orientation, first cables 130 are forced under tension to pull first pivot means 35 out of its rest location. This forces the entire support structure to assume its unfolded orientation. Table 10 lands upon the floor fully unfolded and ready for use.

Having thus described my invention what I claim as new, useful and non-obvious and, accordingly secure by Letters Patent of the United States is:

1. A portable, folding table comprising:

a pair of rectangular table top sections;

a peripheral border flange depending from each of said sections;

hinge members interconnecting said flange bottom edges of adjacent sides of said sections to enable folding of said table top sections from a working configuration, wherein said table top sections are coplanar, to a portable configuration, wherein the bottom edges of said flanges are juxtaposed;

two pairs of support legs of rectangular cross section;

a first means hingably securing a first end of each said pair of legs to the underside of each said table top section to fold toward said hinge members within said border flange;

a first rigid cross brace secured between the legs of each pair thereof;

two pairs of support arms of rectangular cross section, each said arm comprising a first and a second section pivotally interconnected by a second pivot means securing facing sides of each to the other;

a third pivot means hingably securing a first end of each said pair of arms to the underside of each said table top section to fold toward said table top section within said border flange;

a fourth pivot means securing a second end of each said pair of arms to said pair of legs to fold toward said table top section into the receptacle formed by said border flange;

a second rigid cross brace secured between the arms of each pair thereof;

a pair of first flexible, non-stretchable cables, one of said cables being pivotally secured between each opposing pair of said second pivot means, each said cable being of length to be in tension when said table top sections are coplanar and when said legs are fully unfolded;

two pairs of flexible, non-stretchable second cables, each individual said second cable being pivotally secured between said first and said second pivot means, each said second cable being of length to be in tension when said table top sections are coplanar and when said legs are fully unfolded.

2. The folding table defined in claim 1 including at least one latch means mounted on said border flange for securing said top sections together when said table is in said portable configuration.

3. The folding table defined in claim 2 including two carrying handles mounted on said border flanges for carrying said table, and at least four support feet mounted upon said border flange on the opposite side said handle for resting said table upon.

4. The folding table defined in claim 1 including a pair of pads, one said pad attached to each said table top section one said pad having a face opening.

* * * * *

UNITED STATES PATENT AND TRADEMARK OFFICE

CERTIFICATE OF CORRECTION

PATENT NO. : 5,009,170
DATED : April 23, 1991
INVENTOR(S) : Eli G. Spehar

It is certified that error appears in the above-indentified patent and that said Letters Patent is hereby corrected as shown below:

In claim 1, line 12, after "a first" and before "means", insert --pivot--.

Signed and Sealed this

Eleventh Day of November, 1997

*Attest:*

Bruce Lehman

BRUCE LEHMAN

*Attesting Officer*

*Commissioner of Patents and Trademarks*